US005862837A

United States Patent [19]

Guenther et al.

[11] Patent Number: 5,862,837

[45] Date of Patent: Jan. 26, 1999

[54] THREAD HOLDER FOR A BRINGER RAPIER

[75] Inventors: Kurt Guenther, Rüti; Anton Egloff, Galgenen; Paul Lincke, Kollbrunn, all of Switzerland

[73] Assignee: Sulzer Rueti AG, Winterthur, Switzerland

[21] Appl. No.: 732,793

[22] Filed: Oct. 15, 1996

[30] Foreign Application Priority Data

Oct. 17, 1995 [CH] Switzerland ..... 02 940/95

[51] Int. Cl.[6] ..... D03D 47/23

[52] U.S. Cl. ..... 139/448; 139/438; 139/444

[58] Field of Search ..... 139/438, 448, 139/444; 24/132 R; 242/125.1, 172

[56] References Cited

U.S. PATENT DOCUMENTS

| | | | |
|---|---|---|---|
| 3,915,201 | 10/1975 | Mackie | 139/448 |
| 4,040,454 | 8/1977 | Genini | 139/448 |
| 4,259,997 | 4/1981 | Tosches | 139/448 |
| 4,423,756 | 1/1984 | Dewas | 139/448 |
| 5,348,057 | 9/1994 | Corain et al. | 139/448 |

FOREIGN PATENT DOCUMENTS

| | | |
|---|---|---|
| 0 624 671 A1 | 11/1994 | European Pat. Off. . |
| 1.122.422 | 9/1956 | France . |
| 508 075 | 7/1971 | Switzerland . |

*Primary Examiner*—Andy Falik
*Attorney, Agent, or Firm*—Townsend and Townsend and Crew LLP

[57] ABSTRACT

A thread holder comprises two holding members which form a gap that has a round cross-sectional shape and increasing width. Each of the thread holders is journalled on the other holding member at at least one bearing location which is executed as a bearing surface. With this arrangement the journalled holding member can easily assume a holding position that is ideal for a thread being used. The thread holder is suitable in particular for a bringer rapier of a rapier weaving machine.

11 Claims, 5 Drawing Sheets

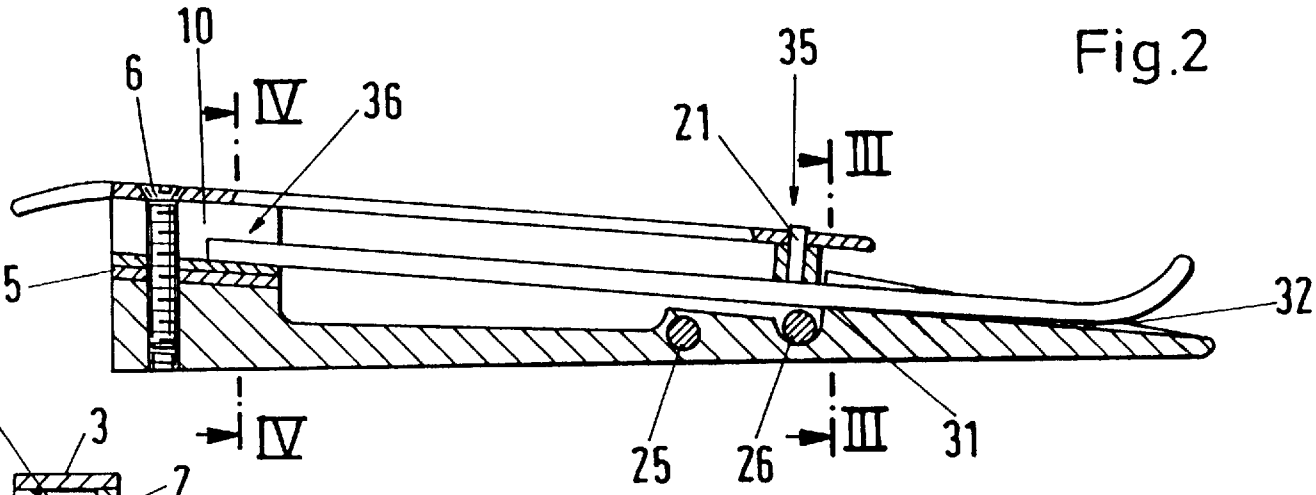
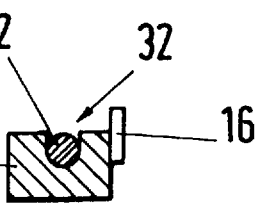
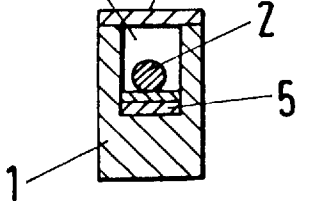
Fig.4
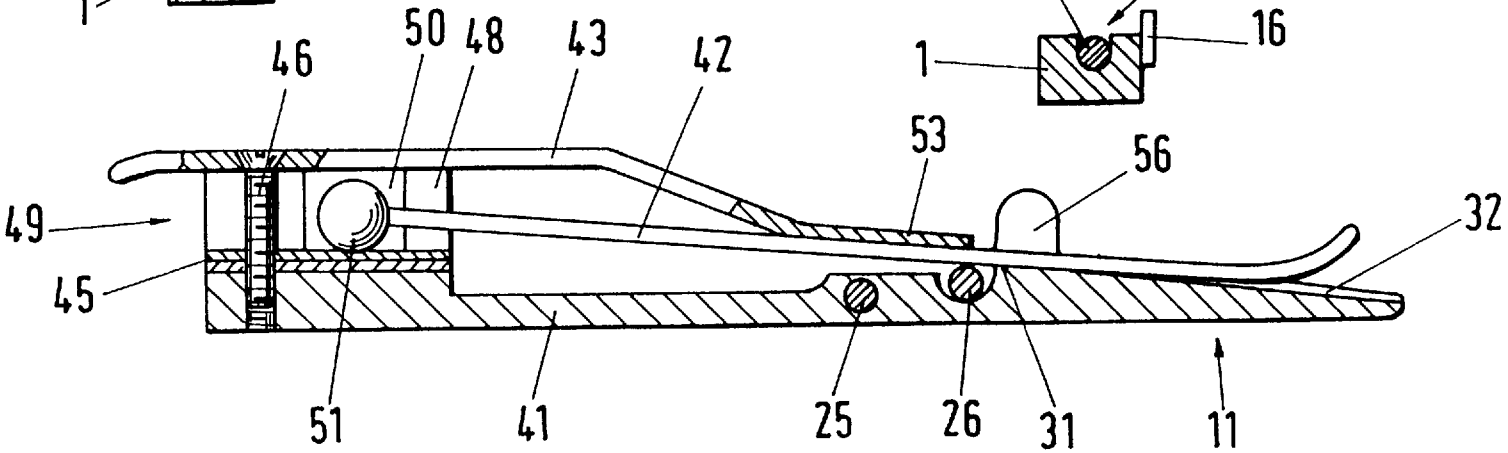

THREAD HOLDER FOR A BRINGER RAPIER

BACKGROUND OF THE INVENTION

1. Field of the Invention

The invention relates to a thread holder and to a rapier weaving machine with a thread holder.

2. Description of the Prior Art

Thread holders, so-called bolt clamps, are known. In one kind, one holding member is firmly connected to the other holding member. In a different kind, one holding member is arranged movably on the other holding member, with the one holding member being prestressed against the other holding member by means of a spring and the holding force being determined by the spring; or the holding members are movable relative to one another in the longitudinal extension. These thread holders have the disadvantages that a change in the cross-section and in the width of the clamping gap either takes place against the force of the spring, whereby, for example, a thread is relatively strongly stressed, or is not possible and is not provided, as a result of the arrangement of the holding members, since the thread is damaged when being introduced.

SUMMARY OF THE INVENTION

The object of the invention is to improve a thread holder in such a manner that the clamping gap can be adjusted automatically in dependence on the thread thickness.

This object is satisfied in accordance with the invention by each of which is journalled on the other holding member at at least one bearing location and which holding members form a gap for the accommodation of a thread. The bearing location is utilized as a support surface, and the holding members are journalled in such a way so that at least one holding member is movable perpendicularly to its longitudinal axis.

The advantage of the invention is to be seen essentially in the possibility of changing the clamping gap.

BRIEF DESCRIPTION OF THE DRAWINGS

FIG. 2 is a longitudinal sectional view of the thread holder shown in FIG. 1

FIG. 3 is a sectional view taken along the line III—III in FIG. 2;

FIG. 4 is a sectional view taken along the line IV—IV in FIG. 2;

FIG. 5 is a longitudinal sectional view as in FIG. 2 of an alternative embodiment of a thread holder in accordance with the present invention;

DETAILED DESCRIPTION OF THE PREFERRED EXEMPLARY EMBODIMENTS

Figure 1:
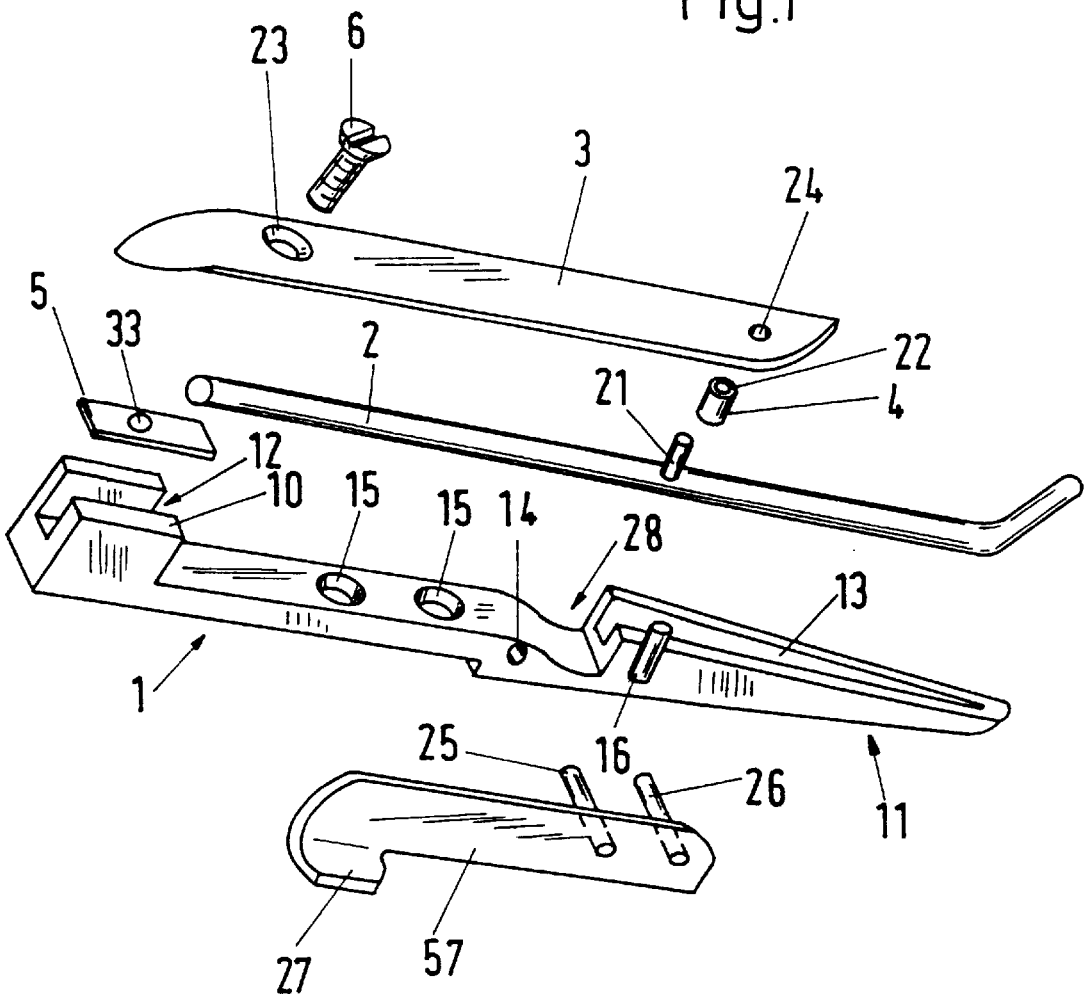
FIG. 1 is an exploded view of an embodiment of a thread holder in accordance with the present invention.

Reference is made to FIGS. 1 to 4. The thread holder consists substantially of a first holding member 1, a second holding member 2, a retaining member 3, a sleeve 4, a bearing member 5, a screw 6, and an actuation lever 7.

The first holding member 1 is an elongate body with a first section 10 which is formed at one end of the body and a second section 11 which is formed to taper towards the other end of the body. A U-shaped groove 12, which extends in the longitudinal direction of the body, is formed in the first section 10. A groove-shaped cut-out 13 with a round base surface and whose cross-section increases in the direction away from the free end of the second section 11 is formed in the second section. Furthermore, the first holding member 1 has a bore 14 for the actuation lever 7, two holes 15 for securing the thread holder, and an abutment member 16 in order to prevent a thread being pulled through in the longitudinal direction of the thread holder. The holding region for the thread is determined by the abutment member 16, and indeed beginning at the free end of the second section 11 up to the holding member 16.

The second holding member 2 is an elongate needle with a bent section at one end, which forms an insertion aid for the thread. The needle 2 has a circular cross-section and an outer diameter which is less than the width of the groove. A spigot 21 is provided on the needle. The sleeve 4 has a through-going hole 22 whose cross-section is matched to that of the spigot.

The retaining member 3 is a leaf spring 3 which has a through-bore 23 with a countersink and a through-going hole 24. The actuation lever 7 has a rotation pin 25 which determines the pivotal axis of the actuation lever 7 and is pivotally mounted on the body 1.

The actuation lever is executed as a two-armed lever, with a pin 26 being mounted on the one lever arm and a lug 27 being formed at the other lever arm. A cut-out 28 which is directed perpendicular to the needle axis is formed on the body 1 and accommodates the pin 26.

FIG. 2 shows the thread holder in the assembled state. Two bearing members 5 are placed in the groove 12. The needle 2 is placed in the groove 12 and lies on the bearing members 5 at one end and on an edge 31 at the other end so that a wedge-shaped gap 32 having a curved cross-section is present between the needle 2 and the surface of the cut-out 13 in the first section 10 of the body 1. The needle 2 is loosely journalled by the spigot 21 in the leaf spring 3. The leaf spring 3 lies on the section 10 and is held by means of the screw 6. The bearing members 5 have a through-going hole 33 in order to fasten the bearing members 5 in the groove 12. As seen in FIG. 2 the needle 2 is arranged on the one end at the location 35 and at the other end on the bearing location 36 so that the needle 2 is rotatable about the spigot 21. This has in particular the advantage that the needle can assume the best holding position when drawing in a thread. Further important advantages of the thread holder consist in the fact that the gap 32 is present in the holding region between the surface of the cut-out 13 and the outer surface of the needle 2, that no contact exists between the body and the needle, and that the width of the gap 32 can be adjusted in order to adjust the clamping gap 32 to the thickness of the thread. For this, it is only necessary to decrease or increase the number or thickness of the bearing members 5 respectively.

The thread holder shown in FIG. 5 has substantially the same basic construction as the previously described thread holder and comprises a first holding member 41, a second holding member 42, a resetting spring 43, two bearing members 45, a screw 46, and the non-illustrated actuation lever 7.

The first holding member 41 is an elongate body with a first section 48 and a second section 11. In the first section 48 there is a substantially U-shaped cut-out 49 which extends in the longitudinal direction of the body 41. Furthermore, two cut-outs 50 are provided in the groove 49 in order to accommodate the bearing body 51. Two lugs 56 are formed at the end region of the first section 11 in order to guide the needle 42 during the cleaning of the thread holder.

The second holding member is an elongate needle 42 with a curved section at one end, which forms the insertion aid for the thread and has a bearing body 51 at the other end. The needle 52 is placed in the cut-out 13, with the bearing body 51 being movably accommodated in the cut-outs 50 and the needle 42 lying on the edge 31. The leaf spring 43 is secured to the section 48 by means of the screw 46. The leaf spring 43 has a section 53 which is contacted by the needle 42 in order to limit the movement of the needle 42 upwardly. The same advantages result from this arrangement as from the embodiment of FIGS. 1 or 2. A further advantage of this embodiment results if a spacing is present between the underside of the leaf spring section 53 and the edge 31. In this way the needle 42 is freely movable within the cut-out and can assume the best holding position for differing thread thicknesses or, in other words, the thread holder adjusts itself automatically. The adjustment of the gap 32 in this embodiment proceeds analogously to that in the embodiment of FIG. 2. The bearing members 45 have an outline which corresponds to the groove 49.

Figure 6:
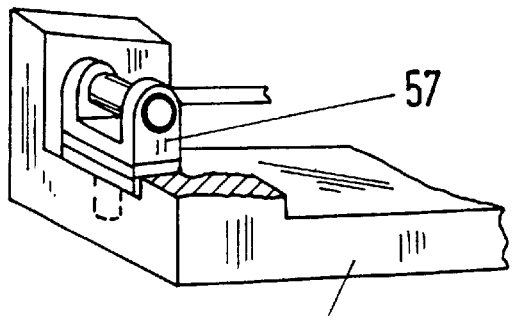
FIG. 6 is a perspective view of an embodiment of a bearing arrangement.
Figure 7:
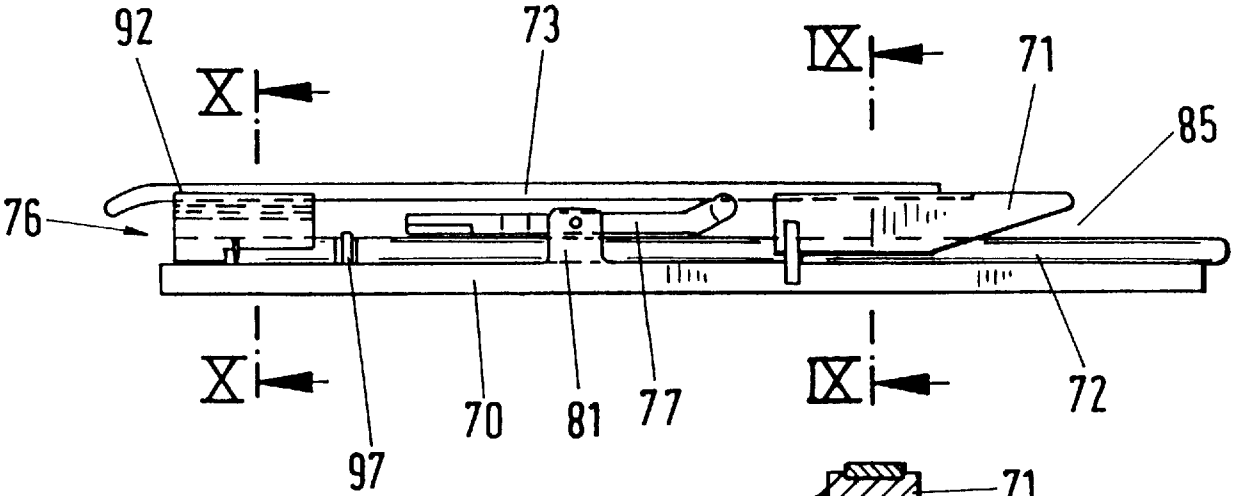
FIG. 7 is a side elevation view of a second alternative embodiment of the thread holder in accordance with the present invention.
Figure 9:
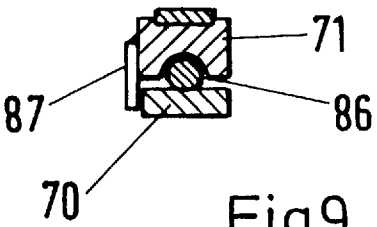
FIG. 9 is a sectional view taken along the line IX—IX in FIG. 7.
Figure 10:
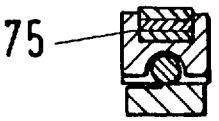
FIG. 10 is a sectional view taken along the line X—X in FIG. 7.

FIG. 6 shows a different embodiment of a bearing body, e.g. a universal joint 57.

The thread holder illustrated in FIGS. 7 to 10 comprises a lower part 70, a first holding member 71, a second holding member 72, a retaining member 73, three bearing members 75, a bearing part 76, and an actuation lever 77.

The lower part 70 is an elongate body with a formation 81 on which the actuation lever 77 is pivotally mounted and with two bearing locations 82, 83 for the second holding member 72.

The first holding member 71 is an elongate body with a rectangular cross-section having an obliquely extending front face 85 and a groove 86 with a semicircular cross-section which extends in the longitudinal direction of the body. An abutment organ 87 is secured to the body in order to prevent a pulling through of the thread in the longitudinal direction of the body and to determine the holding region for the thread.

The retaining member 73 is a leaf spring which is connected by means of screws 88, 89 to the first holding member 71 at one end and to the bearing part 76 at the other end.

A spring bar can be used instead of the leaf spring. The elastic holding of a holding member, e.g. a leaf spring, spring bar or the like, gives in particular the advantage that a holding force which is determined by the spring force of the spring and which becomes increasingly effective first results at increasing thread thickness and thread penetration depth into the holding region. Thread breaks can thereby be largely avoided.

The bearing part 76 is a body in the shape of a rectangular prism which has at its underside a section 90 to be laid on the lower part 70 and a groove 91 to accommodate the needle 72 and has at its upper side a cut-out 92 to accommodate the leaf spring 73, with the groove 91 and the cut-out 92 being arranged parallel to one another.

The bearing members 75 have an outline which corresponds to the cut-out 92 and an insubstantial thickness, e.g. up to 0.5 mm. In the assembled state the needle 72 is journalled at the lower part 70 and the body 71 is secured to the lower part 70 via the leaf spring 73 in such a manner that the body 71 lies on the needle 72 at one end 95 and a wedge-shaped gap 96 is formed. The arrangement is designed in accordance with the invention in such a manner that no contact exists between the body 71 and the needle 72 in the holding region bounded by the abutment member 87. The width of the gap can be changed by increasing the number and/or thickness of the bearing or packing members 75.

The bearing locations 82, 83 are utilized as support bearings so that the needle 72 is movable in the plane formed by the bearing surface. In order to prevent the pulling out of the needle 72 a holding member 97 gripping over the needle, e.g. in U shape, is provided. The advantage of this arrangement consists in particular in that the needle can assume the best holding position for different thread thicknesses.

In a modified embodiment of the previously described thread holder the first holding member 71 can be journalled and the second holding member 72 fixed.

Figure 12:
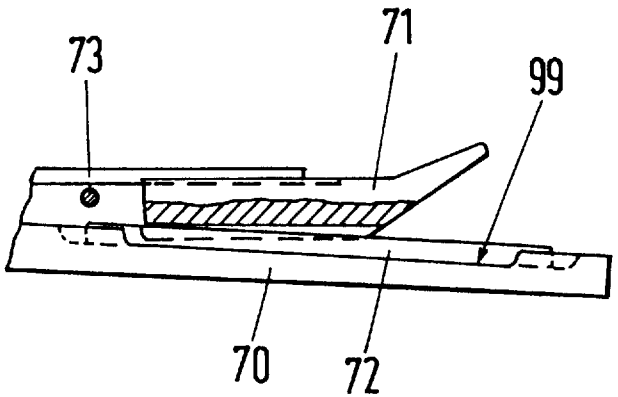
FIG. 12 illutrates a modified embodiment for journalling the needle.

As shown in FIG. 12 the needle 72 is journalled in a floating manner in the lower part 70. For this purpose, an elongate dip or depression 99 in which the needle can move in the longitudinal direction is formed in the lower part 70.

Figure 8:
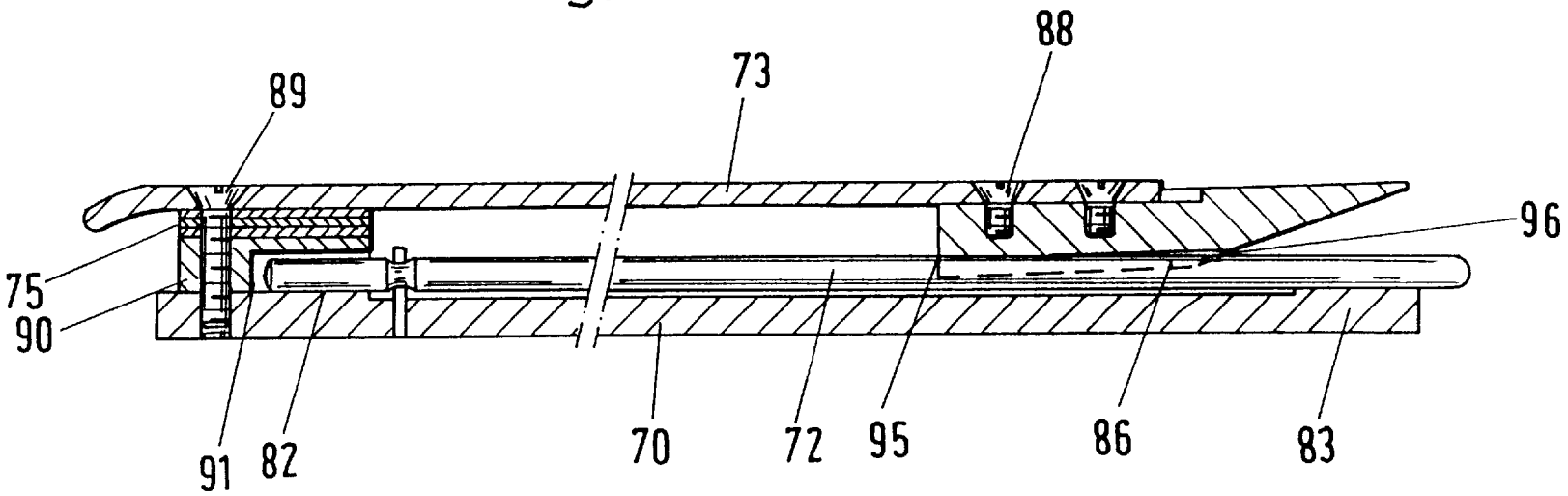
FIG. 8 is a longitudinal sectional view of the thread holder shown in FIG. 7.
Figure 11:
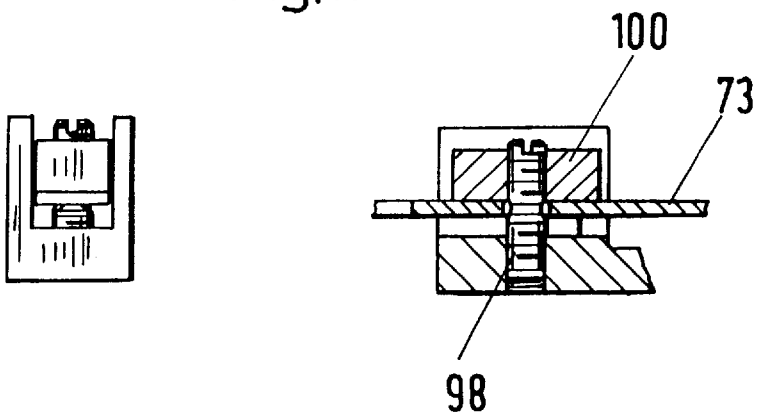
FIG. 11 illutrates a alternative embodiment of an arrangement for changing the width of the clamping gap.

Instead of the holding arrangement of the leaf spring 73 as in FIG. 8, the embodiment illustrated in FIG. 11 can be chosen in order to facilitate the adjustment of the gap. A setting screw 98 serves this purpose in order to displace the leaf spring 73, which is securely connected to a block 100, and consequently to adjust the gap 96.

Figure 13:
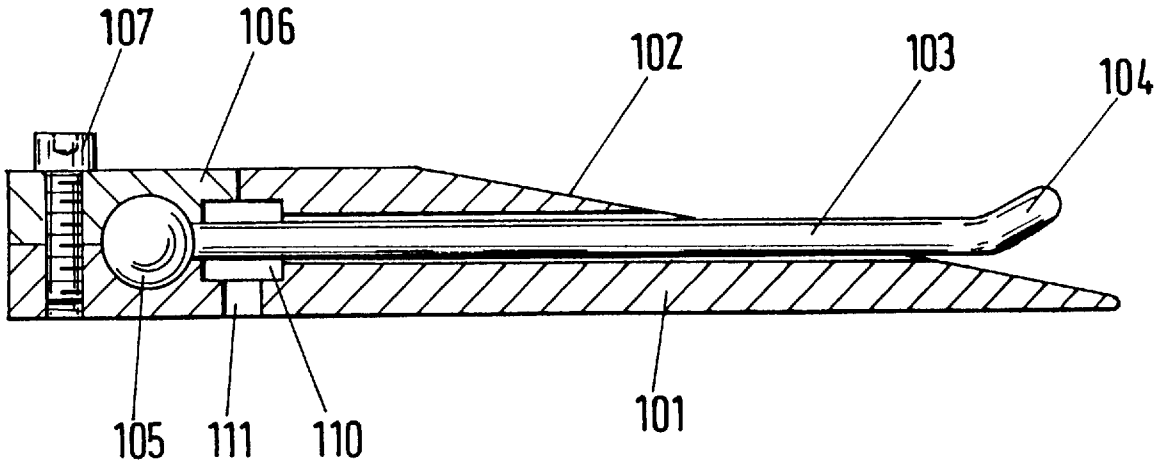
FIG. 13 is a third alternative embodiment of the thread holder in accordance with the present invention.

FIG. 13 shows a different embodiment of the thread holder. The thread holder consists of a tube-shaped body 101 with an extremely acutely bevelled front face 102, a needle 103 with a curved section 104 at one end and a ball 105 at the other end, a holding member 106 for the needle 103, and a screw 107. A hemispherical cut-out is formed in both the body 101 and in the holding part 106, which cut-outs are executed in such a manner that the ball 105 is loosely journalled when the holding part 106 is secured to the body 101 by means of the screw 107. In this embodiment the needle 103 is freely movable within the tube-shaped body 101.

A cylindrical chamber 110 surrounding the needle 103 and a bore ill which can be connected to a source of compressed air (not shown) are provided for the purpose of cleaning the thread holder.

The thread holder contains two holding members 1, 2, which form a gap 32 with a round cross-sectional form and increasing width. The holding members 1, 2 are each journalled on the other holding member at at least one bearing location 36, which is utilized as a support surface. With this arrangement the journalled holding member can assume the best holding position in an advantageous manner.

The thread holder is suitable in particular for a bringer gripper of a rapier weaving machine.

What is claimed is:

1. A thread holder for a bringer rapier, the thread holder comprising two holding members each defining a respective longitudinal axis, each of which is journalled on the other holding member at at least one bearing location and which holding members form a gap for the accommodation of a thread with their respective longitudinal axes being parallel to one another, wherein the bearing location is utilized as a support surface; and wherein the holding members are journalled in such a way so that at least one holding member is movable perpendicularly to its longitudinal axis.

2. A thread holder in accordance with claim 1 wherein the bearing surface is formed by a section of a sphere.

3. A thread holder in accordance with claim 1 wherein the bearing location is formed by a universal joint.

4. A thread holder in accordance with claim 1 wherein the bearing location is formed by a pivot or spigot bearing.

5. A thread holder in accordance with claim 1 wherein the bearing location is formed by a support bearing.

6. A thread holder in accordance with claim 1 further comprising a second bearing location.

7. A thread holder in accordance with claim 6 wherein the first and the second bearing locations are arranged at a spacing with respect to one another; and wherein the holding members are arranged in such a manner that a section of the holding members lies within one another away from the bearing location in order to form the gap.

8. A thread holder in accordance with claim 1 further comprising means for changing the level of the bearing surface and thereby the width for a wedge-shaped thread introduction gap.

9. A weaving machine comprising a thread holder for a bringer rapier, the thread holder comprising two holding members each defining a respective longitudinal axis, each of which is journalled on the other holding member at at least one bearing location and which holding members form a gap for the accommodation of a thread with their respective longitudinal axes being parallel to one another, wherein the bearing location is utilized as a support surface;

wherein the holding members are journalled in such a way so that at least one holding member is movable perpendicularly to a longitudinal axis; and wherein the thread holder is used as a bringer rapier that is mounted on a rapier head.

10. A weaving machine in accordance with claim 9 further comprising a device in order to open the gap for cleaning purposes.

11. A weaving machine in accordance with claim 10 further comprising a second device consisting of a chamber and a connecting bore for supplying air in order to clean the thread holder.

* * * * *